United States Patent [19]

Molayem et al.

[11] Patent Number: 4,483,259

[45] **Date of Patent: * Nov. 20, 1984**

[54] METHOD AND COMPOSITION FOR REMOVAL OF GASEOUS CONTAMINANTS PRODUCED IN COMBUSTION OF FOSSIL FUELS OR PRESENT IN REDUCING GASES

[75] Inventors: Benjamin Molayem, Silver Spring; David Garrett, Fort Washington, both of Md.

[73] Assignee: Benmol Corporation, Alexandria, Va.

[ * ] Notice: The portion of the term of this patent subsequent to Jun. 21, 2000 has been disclaimed.

[21] Appl. No.: 506,128

[22] Filed: Jun. 20, 1983

Related U.S. Application Data

[63] Continuation-in-part of Ser. No. 280,978, Jul. 7, 1981, Pat. No. 4,388,877.

[51] Int. Cl.[3] ..... F23J 11/00

[52] U.S. Cl. ..... 110/345; 44/1 SR; 423/244

[58] Field of Search ..... 110/344, 345, 343, 342; 44/1 SR; 423/244

[56] References Cited

U.S. PATENT DOCUMENTS

| | | | |
|---|---|---|---|
| 4,084,545 | 4/1978 | Nack et al. . | |
| 4,168,291 | 9/1979 | Libutti et al. | 110/345 X |
| 4,191,115 | 3/1980 | Yang et al. . | |
| 4,335,084 | 6/1982 | Brogah | 110/345 |
| 4,369,719 | 1/1983 | Engstrom et al. | 110/345 |
| 4,388,877 | 6/1983 | Molayem et al. | 110/344 |

*Primary Examiner*—Edward G. Favors

*Attorney, Agent, or Firm*—James J. Brown

[57] ABSTRACT

A method and composition are described for catalytically converting unburned hydrocarbons and carbon monoxide to carbon dioxide and reducing nitrogen oxides to nitrogen during or subsequent to the combustion of fossil fuels while adsorbing sulfur oxides. The method and composition of the invention are also useful for treating reducing gases containing one or more of hydrogen sulfide, ammonia, and carbonyl sulfide to reduce these gaseous components to non-polluting components such as nitrogen, hydrogen, and water while adsorbing sulfur so that it can be removed from the system. The method and composition of the invention are especially characterized by their use to remove polluting gaseous components from fossil fuels during combustion or subsequent to combustion or from reducing gases and in various stages as long as the catalyst adsorbent system of the invention is brought into contact with the gaseous contaminants being removed.

13 Claims, No Drawings

METHOD AND COMPOSITION FOR REMOVAL OF GASEOUS CONTAMINANTS PRODUCED IN COMBUSTION OF FOSSIL FUELS OR PRESENT IN REDUCING GASES

This application is a continuation-in-part of application Ser. No. 280,978 filed July 7, 1981 now U.S. Pat. No. 4,388,897.

The present invention relates to a process for the combustion of fossil fuels wherein combinations of adsorbents and catalysts are utilized as materials (called SORCAT by the Inventors) either during or subsequent to combustion to remove gaseous contaminants produced by the combustion process, and to the treatment of reducing gases to remove contaminants such as hydrogen sulfide, carbonyl sulfide, and ammonia.

Fossil fuels which are combusted according to the present invention include coal, lignite, peat, oil shale, tar sand, bitumens, petroleum crude and its fractions, natural gases, fuel gases derived from gasification of other fuels, and synthetic liquids or solids derived from other fuels.

BACKGROUND OF THE INVENTION

It is known to combust coal or other fuels in fluidized beds of adsorbent materials in order for sulfur oxide gases emanating from sulfurous materials in the coals or other fuels to be adsorbed or captured by the bed material and not otherwise released in the flue gases derived from the combustion process. During these combustion processes, wherein sulfur oxides are captured by beds of adsorbent materials, other environmental contaminants such as unburned hydrocarbons, nitrogen oxides and carbon monoxide are, however, generally released in the flue gas in various concentrations. It is also known that various catalytic materials can be used for combustion processes, such as automobile exhaust gases, for the purpose of reducing emissions of unburned hydrocarbons, oxidizing carbon monoxide to carbon dioxide and reducing nitrogen oxides to nitrogen. These catalytic converters generally pass sulfur oxides through unchanged or oxidize sulfur oxides to their highest level of oxidation thereby producing constituents of airborne sulfites and sulfates which may contribute, along with hydrocarbons and nitrogen oxides, to atmospheric phenomena known as "smog" and "acid-rain".

It has not, however, been proposed to employ combinations of adsorbents and catalysts together during combustion of fuels to reduce emissions of all of these contaminants, nor has it been recognized that the use of these respective components in combination realizes enhanced reduction of sulfur oxides and other contaminating emissions.

DESCRIPTION OF THE INVENTION

The present invention relates to a method for catalytically converting unburned hydrocarbons and carbon monoxide to carbon dioxide and reducing nitrogen oxides to nitrogen in the combustion of fossil fuels using a synergistic combination of a catalytic material physically combined onto an adsorbent matrix. Sulfur oxides which may be present are also adsorbed. The adsorbent and catalytic components can be regenerated when their adsorbent and catalytic properties become diminished in the process of the invention.

The sorbent-catalyst of the present invention can be used to treat reducing gases such as fuel gases to convert such contaminants as hydrogen sulfide, carbonyl sulfide and ammonia to harmless gases such as nitrogen and hydrogen, water, and adsorbed sulfur. Following such treatment the sorbent-catalyst can then be regenerated by oxidative treatment with oxygen to remove adsorbed substances such as sulfur from the sorbent-catalyst. An additional benefit of the sorbent-catalyst system of this invention is that it can result in removal of fine particulates such as ash or carbon from the product gases especially when used in a fixed or moving bed.

The present invention is based on compositions of solid materials formed from adsorbent matrix which is physically combined with catalytic substances and their use in combustion processes for fuels. The catalytic materials are metals or their oxides, alone or in combination.

The adsorbent matrix used according to the invention is:

Dolomites

Alkali and alkaline earth metal oxides, aluminates, titanates, vanadates, chromates or salts of other amphoteric metal oxides.

Preferred are:

$CaAl_2O_4$, $BaTiO_3$, $CaTiO_3$, and Calcium Aluminate Cement

Combined with the adsorbent component are the following catalytic materials preferably by impregnation onto the matrix:

Base metals or their oxides such as the transition metals and especially: Ni, CO, Mo, Mn, Cu, Zn, Cr. Precious metals or their oxides such as: Ir, Pt, Pd, Rh, Re.

Preferred catalytic materials are: Ni, Cu, Co, Pt, Pd, Rh; each alone or in combinations.

Preferred range of catalyst to adsorbent matrix is from 0.05 to 5.0 weight percent and most preferred 0.05 to 0.5 weight percent. Where combinations of the precious metals are used, the preferred weight ratio of Pt/Pd is 5/3 to 5/1, and the preferred weight ratio of Pt/Rh is 5/1 to 12/1.

The combined use of the adsorbent matrix and physically combined catalytic component together has been found to result in enhanced reductions of the respective contaminating emissions beyond what is found when adsorbent and catalyst are separately employed.

The present invention can be carried out during combustion such as in a fluidized combustion bed in which the bed material is maintained in an expanded, fluid state by air and gaseous combustion products or in a post-combustion stage. The expanded fluidized bed, during combustion may have a depth from 1–16 feet preferably is from 4–12 feet. Spent bed material is continuously withdrawn during operation, and replaced with fresh or regenerated sorbent-catalyst at a rate such that the molar ratio of sulfur sorbent active cation per part of sulfur in the feed fuel is maintained in the range of 0.5 to 10, preferably in the range of 1 to 5, and most preferably 1.5 to 3.

The range of velocities for combustion gases in the fluidized bed during fluidized bed combustion may be from 1 to 14 actual cubic feet of gas per second per square foot of fluidized bed area, however, the preferred range of operation is 4 to 10 actual cubic feet of gas per second per square foot of fluidized bed area.

The sorbent-catalyst composition of the invention also functions effectively to remove contaminants when used in the combustion of fossil fuels in other modes than a fluidized bed. For example, the sorbent-catalyst composition can be utilized directly in the combustion zone itself, a post-combustion stage or in a different zone of the combustion device or in a separate contacting device or space such as a packed or moving bed or duct or combination thereof. Particularly in the burning of coal as a fuel, the addition of the sorbent-catalyst of the invention in the free space above the combustion zone allows the burning of high sulfur coal without the use of additional scrubber equipment.

A wide range of temperatures can be used in accordance with the present invention and can be 300 degrees to 2000 degrees F. with 800 degrees to 1700 degrees F. preferred.

While separation subsequent to combustion is not necessary, since the ash is inert with regard to regeneration and subsequent recycle to the combustion process, spent material can be separated from ash by screening, elutriation or other method known in the art. The spent bed material can then be regenerated with regard to its sulfur capture capability.

The combination sorbent-catalyst (SORCAT) of the present invention can be regenerated with regard to its $SO_2$ adsorbent capabilities, by the method of Ruth, et al. "Environmental Science and Technology", Vol. 13, No. 6, June, 1979, and by the method of Snyder, et al. "Sulfation and Regeneration of Synthetic Additives", Proceedings of the Fourth International Conference on Fluidized Bed, December, 1975, or by other methods known in the art. Therefore, the sorbent-catalyst need not be discarded but may be recycled many times before being processed to recover the catalytic metals.

The sorbent-catalyst material will become diluted with fuel ash when solid fuels are combusted, however, there is very little ash during oil combustion, and virtually no ash when gases are combusted. By its nature, the carbon content during combustion is very low of the order of 0–6% and preferably 0–0.6%. The rate of material withdrawal is based upon the efficiency of sulfur capture from combustion gases.

The following examples are provided to demonstrate the present invention and are not limiting with respect to the scope thereof.

EXAMPLE 1

A high sulfur bituminous coal from the Sewickley seam was combusted in a conventional fluidized bed combustor in which Greer limestone was the fluid bed material. The limestone bed material was used to remove sulfur oxides from the combustion gases, generated within the fluid bed by the coal combustion. Conditions for the operation are shown in TABLE 1.

This operating data shows that a combustion efficiency of 81.92% was achieved with a calcium-to-sulfur molar ratio of 2.5 when combustion a coal of heating value=12,931 Btu per pound. The effluent flue gas contained environmental contaminants equivalent to:

$SO_2$=2.49 pounds per million Btu $NO_x$=1.06 pounds per million Btu

CO=2.54 pounds per million Btu

Unburned Hydrocarbon=0.20 pounds per million Btu

TABLE 1

| | Stream | | | |
|---|---|---|---|---|
| Analysis | Coal Feed | Lime-stone Feed | Com-bustion Air | Flue Gas (Dry) |
| Carbon, wt % | 69.90 | | | |

TABLE 1-continued

| | Stream | | | |
|---|---|---|---|---|
| Analysis | Coal Feed | Lime-stone Feed | Com-bustion Air | Flue Gas (Dry) |
| Hydrogen, wt % | 4.53 | | | |
| Nitrogen, wt % | 0.96 | | 76.80 | 81.50 |
| Oxygen, wt % | 5.46 | | 23.2 | 3.42 |
| Sulfur, wt % | 4.03 | 0.20 | | |
| Moisture, wt % | 1.57 | 0.19 | | 7.47 |
| Ash, wt % | 13.55 | 14.94 | | |
| Lime (CaO), wt % | | 44.30 | | |
| $CO_2$, wt % | | 40.37 | | 14.79 |
| CO, wt % | | | | 0.28 |
| $SO_x$ ($SO_2$ + $SO_3$), ppm | | | | 1,200. |
| $NO_x$ (NO + $NO_2$), ppm | | | | 429. |
| Hydrocarbons, (as $CH_4$), ppm | | | | 393. |
| HCl, ppm | | | | 42. |
| Temperature within Fluidized Bed = 1560° F. | | | | |
| Gas Velocity $ft^3/sec\text{-}ft^2$ = 7.4 | | | | |

This identical type of coal was then thermally combusted in a fluidized bed combustion chamber with sorbent-catalyst A, which was produced by impregnating, agglomerated and calcined barium titanate particles prepared, with 0.1 weight percent Pt plus 0.02 weight percent Pd, plus 0.01 weight percent Rh. Conditions for this operation are shown in TABLE 2.

This operating data shows that a combustion efficiency of 86.03% was achieved with the coal of heating value=12,931 Btu per pound. The effluent gas contained environmental contaminants equivalent to:

$SO_2$=0.03 pounds per million Btu $NO_x$=0.04 pounds per million Btu

CO=0.02 pounds per million Btu

Unburned Hydrocarbon=0.05 pounds per million Btu

TABLE 2

| | Stream | | | |
|---|---|---|---|---|
| Analysis | Coal Feed | Sorbent-Catalyst A | Com-bustion Air | Flue Gas (Dry) |
| Carbon, wt % | 69.90 | | | |
| Hydrogen, wt % | 4.53 | | | |
| Nitrogen, wt % | 0.96 | | 76.8 | 82.46 |
| Oxygen, wt % | 5.44 | | 23.2 | 3.04 |
| Sulfur, wt % | 4.03 | | | |
| Moisture, wt % | 1.52 | | | 8.04 |
| Ash, wt % | 13.55 | | | |
| $CO_2$, wt % | | | | 14.49 |
| CO, wt % | | | | .0023 |
| $SO_x$ ($SO_2$ + $SO_3$), ppm | | | | 146. |
| $NO_x$ (NO + $NO_2$), ppm | | | | 18. |
| Hydrocarbons (as $CH_4$), ppm | | | | 27. |
| Temperature within Fluidized Bed = 1587° F. | | | | |
| Gas Velocity, $ft^3/sec\text{-}ft^2$ = 8.3 | | | | |

EXAMPLE 2

The coal as described in Example 1 was thermally combusted in a fluidized bed combustion chamber with sorbent-catalyst B, which was produced by co-precipitation from solution mixtures of sodium silicate, sodium hydroxide, sodium aluminate, and calcium nitrate. The slurry which resulted was filtered, washed, dried, and then heated to 1110 degrees C., thus forming a material with empirical structure $(CaO)_3(Si—Al_2O_3)_{\frac{1}{2}}$. This material was then impregnated with a solution mixture of chloroplatinic acid, palladium chloride and rhodium chloride such that the total metal loading was 0.2 weight percent of the previously prepared dry powder, and the platinum to pallidium ratio was 5:2 by weight and the platinum to rhodium ratio was 9:1 by weight. The resulting moist powder was pelleted in a pellet press and the pellets were calcined at 400 degrees C.

Conditions for this operation are shown in TABLE 3.

A portion of the material prepared, with empirical formula $(CaO)_3(SiO_2—Al_2O_3)_{\frac{1}{2}}$, was pelleted without treatment with the catalytic compounds, Pt, Pd, and Rh, and used in the same combustion process. These results are shown in TABLE 4.

TABLE 3

| Analysis | Stream: Coal Feed | Sorbent Catalyst, B | Combustion Air | Flue Gas (Dry) |
|---|---|---|---|---|
| Carbon, wt % | 69.90 | | | |
| Hydrogen, wt % | 4.53 | | | |
| Nitrogen, wt % | 0.96 | | 76.8 | 81.74 |
| Oxygen, wt % | 5.44 | | 23.2 | 3.3 |
| Sulfur, wt % | 4.03 | | | |
| Moisture, wt % | 1.52 | | | (8.60) |
| Ash, wt % | 13.55 | | | |
| $CO_2$, wt % | | | | 14.87 |
| CO, wt % | | | | .06 |
| $SO_x$ ($SO_2$ + $SO_3$), ppm | | | | 214. |
| $NO_x$ (NO + $NO_2$), ppm | | | | 86. |
| Hydrocarbons (as $CH_4$), ppm | | | | 58. |
| Temperature within Fluidized Bed = 1612° F. | | | | |
| Gas Velocity, $ft^3/sec\text{-}ft^2$ = 7.9 | | | | |

TABLE 4

| Analysis | Stream: Coal Feed | Sorbent $(CaO)_3(S_iO_2.Al_2O_3)_{\frac{1}{2}}$ | Combustion Air | Flue Gas (Dry) |
|---|---|---|---|---|
| Carbon, wt % | 69.90 | | | |
| Hydrogen, wt % | 4.53 | | | |
| Nitrogen, wt % | 0.96 | | 76.80 | 81.81 |
| Oxygen, wt % | 5.46 | 0. | 23.2 | 3.2 |
| Sulfur, wt % | 4.03 | 0. | | |
| Moisture, wt % | 1.57 | | | (7.82) |
| Ash, wt % | 13.55 | | | |
| $CO_2$, wt % | | | | 14.63 |
| CO, wt % | | | | 0.30 |
| $SO_x$ ($SO_2$ + $SO_3$), ppm | | | | 280. |
| $NO_x$ (NO + $NO_2$), ppm | | | | 480. |
| Hydrocarbons (as $CH_4$), ppm | | | | 393. |
| Temperature within Fluidized Bed = 1580° F. | | | | |
| Gas Velocity, $ft^3/sec\text{-}ft^2$ = 8.0 | | | | |

EXAMPLE 3

A quantity of calcium titanate was prepared by dry blending stoichiometric quantities of dry powders of calcium carbonate and titanium dioxide and heating the resultant mixture in a kiln at 1100 degrees C.

A portion of the calcined powder was slurried with a mixture of chloroplatinic acid, palladium chloride, and rhodium chloride solutions, evaporated to dryness and calcined over 400 degrees C. The resultant solids were pelleted and used, as in Example 1, for the fluidized bed combustion of the coal used in Example 1. This bed material, referred to as SORCAT C had 0.1 weight percent Pt+Pd+Rh admixed therein, with 5/3 being the ratio of Pt/Pd, and 5/1 being the ratio of Pt/Rh.

Results of this combustion appear in TABLE 5.

The remaining portion of prepared calcium titanate, without catalytic materials treatment, was likewise used to combust the coal of Example 1. These results appear in TABLE 6.

TABLE 5

| Analysis | Stream: Coal Feed | Sorbent-Catalyst C | Combustion Air | Flue Gas (Dry) |
|---|---|---|---|---|
| Carbon, wt % | 69.90 | | | |
| Hydrogen, wt % | 4.53 | | | |
| Nitrogen, wt % | 0.96 | | 76.80 | 81.37 |
| Oxygen, wt % | 5.46 | | 23.2 | 2.70 |
| Sulfur, wt % | 4.03 | 0. | | |
| Moisture, wt % | 1.57 | 0. | | (8.42) |
| Ash, wt % | 13.55 | | | |
| $CO_2$, wt % | | | | 15.90 |
| CO, wt % | | | | 0.01 |
| $SO_x$ ($SO_2$ + $SO_3$), ppm | | | | 94. |
| $NO_x$ (NO + $NO_2$), ppm | | | | 90. |
| Hydrocarbons (as $CH_4$), ppm | | | | 75. |
| Temperature within Fluidized Bed = 1594° F. | | | | |
| Gas velocity, $ft^3/sec\text{-}ft^1$ = 7.2 | | | | |

TABLE 6

| Analysis | Stream: Coal Feed | Calcium Titanate | Combustion Air | Flue Gas (Dry) |
|---|---|---|---|---|
| Carbon, wt % | 69.90 | | | |
| Hydrogen, wt % | 4.53 | | | |
| Nitrogen, wt % | 0.96 | | 76.8 | 81.77 |
| Oxygen, wt % | 5.44 | | 23.2 | 2.81 |
| Sulfur, wt % | 4.03 | | | |
| Moisture, wt % | 1.52 | | | (8.06) |
| Ash, wt % | 13.55 | | | |
| $CO_2$, wt % | | | | 15.05 |
| CO, wt % | | | | 0.36 |
| $SO_x$ ($SO_2$ + $SO_3$), ppm | | | | 418. |
| NO (NO + $NO_2$), ppm | | | | 326. |
| Hydrocarbons (as $CH_4$), ppm | | | | 494. |
| Temperature within Fluidized Bed = 1578° F. | | | | |
| Gas Velocity, $ft^3/sec\text{-}ft^2$ = 9.1 | | | | |

EXAMPLE 4

A quantity of commercially available calcium aluminate cement, consisting mostly of $CaAl_2O_4$ was subdivided so that half of the quantity in the form of dry powder was admixed with a minimum amount of water to form a still paste and extruded through a glass tube. The pellets, which were cut from the extrudate, were humidified to cure them then heated to produce maximum strength by forming ceramic bonding. The second half of the original quantity of calcium aluminate cement was admixed with a solution comprising chloroplatinic acid, palladium chloride and rhodium chloride and extruding, pelleting and curing as above, then calcined at over 400 degrees C., labelled sorbent-catalyst D.

This latter portion of calcium aluminate cement, thus was prepared so that it contained 0.1 weight percent metals content comprising Pt, Pd, and Rh with a Pt/Pd ratio by weight of 5/1 and a Pt/Rh ratio by weight of 12/1.

Both portions of calcium aluminate cement were then used separately, to combust the coal of Example 1 in a fluidized bed combustion apparatus.

The results for the first calcium aluminate cement material appear in TABLE 7. The results for the second calcium aluminate cement material, containing Pt, Pd, and Rh, appear in TABLE 8.

TABLE 7

| Analysis | Stream: Coal Feed | Calcium Aluminate Cement | Combustion Air | Flue Gas (Dry) |
|---|---|---|---|---|
| Carbon, wt % | 69.90 | | | |
| Hydrogen, wt % | 4.53 | | | |
| Nitrogen, wt % | 0.96 | | 76.80 | 80.59 |
| Oxygen, wt % | 5.46 | | 23.2 | 2.98 |
| Sulfur, wt % | 4.03 | 0. | | |
| Moisture, wt % | 1.57 | 0. | | (7.70) |
| Ash, wt % | 13.55 | | | |
| $CO_2$, wt % | | | | 16.05 |
| CO, wt % | | | | 0.35 |
| $SO_x$ ($SO_2$ + $SO_3$), ppm | | | | 252. |
| $NO_x$ (NO + $NO_2$), ppm | | | | 644. |
| Hydrocarbons, (as $CH_4$), ppm | | | | 430. |
| Temperature within Fluidized Bed = 1590° F. | | | | |
| Gas Velocity, $ft^3/sec\text{-}ft^2$ = 6.8 | | | | |

TABLE 8

| Analysis | Stream: Coal Feed | Sorbent-Catalyst D | Combustion Air | Flue Gas (Dry) |
|---|---|---|---|---|
| Carbon, wt % | 69.90 | | | |
| Hydrogen, wt % | 4.53 | | | |
| Nitrogen, wt % | 0.96 | | 76.8 | 80.75 |
| Oxygen, wt % | 5.44 | | 23.2 | 2.79 |
| Sulfur, wt % | 4.03 | | | |
| Moisture, wt % | 1.52 | | | (8.42) |
| Ash, wt % | 13.55 | | | |
| $CO_2$, wt % | | | | 16.44 |
| CO, wt % | | | | .02 |
| $SO_x$ ($SO_2$ + $SO_3$), ppm | | | | 116. |
| $NO_x$ (NO + $NO_2$), ppm | | | | 77. |
| Hydrocarbons (as $CH_4$), ppm | | | | 65. |
| Temperature within Fluidized Bed = 1587° F. | | | | |

TABLE 8-continued

| Analysis | Stream: Coal Feed | Sorbent-Catalyst D | Combustion Air | Flue Gas (Dry) |
|---|---|---|---|---|
| Gas Velocity, $ft^3/sec\text{-}ft^2$ = 8.2 | | | | |

EXAMPLE 5

The high sulfur bituminous coal of Example 1 was combusted in a conventional fluidized bed combustor in which Greer. limestone impregnated with 0.5 weight percent $Fe_2O_3$, prepared by dipping in ferric sulfate solution, was the bed material. This material was used to combust the coal as described in Example 1. Conditions for the operation and the results are shown in TABLE 9.

A quantity of calcium titanate was prepared by dry blending stoichiometric quantities of dry powders of calcium carbonate and titanium dioxide and heating the mixture in a kiln at 1100 degrees C. The prepared agglomerates of calcium titanate were then impregnated with 0.5 weight percent $Fe_2O_3$, by dipping in ferric sulfate solution. The calcium titanate impregnated with $Fe_2O_3$ was then used for the fluidized bed combustion of coal as in Example 1. The results of this combustion appear in TABLE 10.

TABLE 9

| Analysis | Stream: Coal Feed | Limestone-$Fe_2O_3$ | Combustion Air | Flue Gas (Dry) |
|---|---|---|---|---|
| Carbon, wt % | 69.90 | | | |
| Hydrogen, wt % | 4.53 | | | |
| Nitrogen, wt % | 0.96 | | 76.80 | 81.93 |
| Oxygen, wt % | 5.46 | | 23.2 | 2.79 |
| Sulfur, wt % | 4.03 | 0. | | |
| Moisture, wt % | 1.57 | 0. | | (7.50) |
| Ash, wt % | 13.55 | | | |
| $C0_2$, wt % | | | | 14.81 |
| CO, wt % | | | | .28 |
| $SO_x$ ($SO_2$ + $SO_3$), ppm | | | | 1170. |
| $NO_x$ (NO + $NO_2$), ppm | | | | 418. |
| Hydrocarbons, (as $CH_4$), ppm | | | | 385. |
| Temperature within Fluidized Bed = 1550° F. | | | | |
| Gas Velocity, $ft^3/sec\text{-}ft^2$ = 8.1 | | | | |

TABLE 10

| Analysis | Stream: Coal Feed | Calcium Titanate-$Fe_2O_3$ | Combustion Air | Flue Gas (Dry) |
|---|---|---|---|---|
| Carbon, wt % | 69.90 | | | |
| Hydrogen, wt % | 4.53 | | | |
| Nitrogen, wt % | 0.96 | | 76.8 | 81.86 |
| Oxygen, wt % | 5.44 | | 23.2 | 2.75 |
| Sulfur, wt % | 4.03 | | | |
| Moisture, wt % | 1.52 | | | (7.70) |
| Ash, wt % | 13.55 | | | |
| $CO_2$, wt % | | | | 15.20 |
| CO, wt % | | | | .11 |
| $SO_x$ ($SO_2$ + $SO_3$), ppm | | | | 355. |
| $NO_x$ (NO + $NO_2$), ppm | | | | 250. |
| Hydrocarbons (as $CH_4$), ppm | | | | 157. |
| Temperature within Fluidized Bed = 1530° F. | | | | |

TABLE 10-continued

| Analysis | Stream: Coal Feed | Calcium Titanate-$Fe_2O_3$ | Combustion Air | Flue Gas (Dry) |
|---|---|---|---|---|
| Gas Velocity, $ft^3/sec\text{-}ft$ = 7.9 | | | | |

EXAMPLES 6–15

The high sulfur bituminous coal in Example 1 was conducted in a conventional fluidized bed combustor. In each test a different bed material was used. The conditions for and the corresponding results of combustion for each test are shown in TABLES 11 through 20.

TABLE 11

| Analysis | Stream: Coal Feed | Calcium Titanate-$Fe_2O_3$ | Combustion Air | Flue Gas (Dry) |
|---|---|---|---|---|
| Carbon, wt % | 69.90 | | | |
| Hydrogen, wt % | 4.53 | | | |
| Nitrogen, wt % | 0.96 | | 76.80 | 81.22 |
| Oxygen, wt % | 5.46 | | 23.2 | 3.00 |
| Sulfur, wt % | 4.03 | 0. | | |
| Moisture, wt % | 1.57 | 0. | | (7.80) |
| Ash, wt % | 13.55 | | | |
| $CO_2$, wt % | | | | 15.30 |
| CO, wt % | | | | .28 |
| $SO_x$ ($SO_2$ + $SO_3$), ppm | | | | 1175. |
| $NO_x$ (NO + $NO_2$), ppm | | | | 420. |
| Hydrocarbons (as $CH_4$), ppm | | | | 387. |
| Temperature within Fluidized Bed = 1550° F. | | | | |
| Velocity, $ft^3/sec\text{-}ft^2$ = 8.5 | | | | |

TABLE 12

| Analysis | Stream: Coal Feed | Sorbent Catalyst C1 | Combustion Air | Flue Gas (Dry) |
|---|---|---|---|---|
| Carbon, wt % | 69.90 | | | |
| Hydrogen, wt % | 4.53 | | | |
| Nitrogen, wt % | 0.96 | | 76.8 | 81.63 |
| Oxygen, wt % | 5.44 | | 23.2 | 3.10 |
| Sulfur, wt % | 4.03 | | | |
| Moisture, wt % | 1.52 | | | (7.50) |
| Ash, wt % | 13.55 | | | |
| $CO_2$, wt % | | | | 15.20 |
| CO, wt % | | | | .04 |
| $SO_x$ ($SO_2$ + $SO_3$), ppm | | | | 71. |
| NO (NO + $NO_2$), ppm | | | | 79. |
| Hydrocarbons (as $CH_4$), ppm | | | | 118. |
| Temperature within Fluidized Bed = 1530° F. | | | | |
| Gas Velocity, $ft^3/sec\text{-}ft^2$ = 8.0 | | | | |

TABLE 13

| Analysis | Stream: Coal Feed | Sorbent Catalyst C2 | Combustion Air | Flue Gas (Dry) |
|---|---|---|---|---|
| Carbon, wt % | 69.90 | | | |
| Hydrogen, wt % | 4.53 | | | |
| Nitrogen, wt % | 0.96 | | 76.80 | 82.14 |
| Oxygen, wt % | 5.46 | | 23.2 | 2.90 |
| Sulfur, wt % | 4.03 | 0. | | |
| Moisture, wt % | 1.57 | 0. | | (7.60) |
| Ash, wt % | 13.55 | | | |
| $CO_2$, wt % | | | | 14.90 |
| CO, wt % | | | | .03 |

TABLE 13-continued

| Analysis | Stream: Coal Feed | Sorbent Catalyst C2 | Combustion Air | Flue Gas (Dry) |
|---|---|---|---|---|
| $SO_x$ ($SO_2$ + $SO_3$), ppm | | | | 68. |
| $NO_x$ (NO + $NO_2$), ppm | | | | 75. |
| Hydrocarbons (as $CH_4$), ppm | | | | 112. |
| Temperature within Fluidized Bed = 1510° F. | | | | |
| Velocity, $ft^3/sec\text{-}ft^2$ = 9.0 | | | | |

TABLE 14

| Analysis | Stream: Coal Feed | Sorbent Catalyst C3 | Combustion Air | Flue Gas (Dry) |
|---|---|---|---|---|
| Carbon, wt % | 69.90 | | | |
| Hydrogen, wt % | 4.53 | | | |
| Nitrogen, wt % | 0.96 | | 76.8 | 82.07 |
| Oxygen, wt % | 5.44 | | 23.2 | 2.85 |
| Sulfur, wt % | 4.03 | | | |
| Moisture, wt % | 1.52 | | | (7.70) |
| Ash, wt % | 13.55 | | | |
| $CO_2$, wt % | | | | 15.00 |
| CO, wt % | | | | .05 |
| $SO_x$ ($SO_2$ + $SO_3$), ppm | | | | 125. |
| NO (NO + $NO_2$), ppm | | | | 80. |
| Hydrocarbons (as $CH_4$), ppm | | | | 98. |
| Temperature within Fluidized Bed = 1505° F. | | | | |
| Gas Velocity, $ft^3/sec\text{-}ft^2$ = 9.2 | | | | |

TABLE 15

| Steam Analysis | Stream: Coal Feed | Sorbent Catalyst C4 | Combustion Air | Flue Gas (Dry) |
|---|---|---|---|---|
| Carbon, wt % | 69.90 | | | |
| Hydrogen, wt % | 4.53 | | | |
| Nitrogen, wt % | 0.96 | | 76.80 | 81.83 |
| Oxygen, wt % | 5.46 | | 23.2 | 2.80 |
| Sulfur, wt % | 4.03 | 0. | | |
| Moisture, wt % | 1.57 | 0. | | (7.70) |
| Ash, wt % | 13.55 | | | |
| $CO_2$, wt % | | | | 15.30 |
| CO, wt % | | | | .04 |
| $SO_x$ ($SO_2$ + $SO_3$), ppm | | | | 128. |
| $NO_x$ (NO + $NO_2$), ppm | | | | 78. |
| Hydrocarbons (as $CH_4$), ppm | | | | 103. |
| Temperature within Fluidized Bed = 1560° F. | | | | |
| Velocity, $ft^3/sec\text{-}ft^2$ = 7.8 | | | | |

TABLE 16

| Analysis | Stream: Coal Feed | Sorbent Catalyst C5 | Combustion Air | Flue Gas (Dry) |
|---|---|---|---|---|
| Carbon, wt % | 69.90 | | | |
| Hydrogen, wt % | 4.53 | | | |
| Nitrogen, wt % | 0.96 | | 76.8 | 81.64 |
| Oxygen, wt % | 5.44 | | 23.2 | 3.05 |
| Sulfur, wt % | 4.03 | | | |
| Moisture, wt % | 1.52 | | | (7.60) |
| Ash, wt % | 13.55 | | | |
| $CO_2$, wt % | | | | 15.20 |
| CO, wt % | | | | .06 |
| $SO_x$ ($SO_2$ + $SO_3$), ppm | | | | 130. |
| NO (NO + $NO_2$), ppm | | | | 140. |
| Hydrocarbons (as $CH_4$), | | | | 210. |

TABLE 16-continued

| Analysis | Stream: Coal Feed | Sorbent Catalyst C5 | Combustion Air | Flue Gas (Dry) |
|---|---|---|---|---|
| ppm | | | | |
| Temperature within Fluidized Bed = 1575° F. | | | | |
| Gas Velocity, $ft^3/sec\text{-}ft^2$ = 7.3 | | | | |

TABLE 17

| Analyis | Stream: Coal Feed | Sorbent Catalyst C6 | Combustion Air | Flue Gas (Dry) |
|---|---|---|---|---|
| Carbon, wt % | 69.90 | | | |
| Hydrogen, wt % | 4.53 | | | |
| Nitrogen, wt % | 0.96 | | 76.80 | 81.68 |
| Oxygen, wt % | 5.46 | | 23.2 | 2.95 |
| Sulfur, wt % | 4.03 | 0. | | |
| Moisture, wt % | 1.57 | 0. | | (7.50) |
| Ash, wt % | 13.55 | | | |
| $CO_2$, wt % | | | | 15.30 |
| CO, wt % | | | | .05 |
| $SO_x$ ($SO_2$ + $SO_3$), ppm | | | | 78. |
| $NO_x$ (NO + $NO_2$), ppm | | | | 77. |
| Hydrocarbons (as $CH_4$), ppm | | | | 95. |
| Temperature within Fluidized Bed = 1515° F. | | | | |
| Velocity, $ft^3/sec\text{-}ft^2$ = 8.2 | | | | |

TABLE 18

| Analysis | Stream: Coal Feed | Sorbent Catalyst C7 | Combustion Air | Flue Gas (Dry) |
|---|---|---|---|---|
| Carbon, wt % | 69.90 | | | |
| Hydrogen, wt % | 4.53 | | | |
| Nitrogen, wt % | 0.96 | | 76.8 | 82.12 |
| Oxygen, wt % | 5.44 | | 23.2 | 2.80 |
| Sulfur, wt % | 4.03 | | | |
| Moisture, wt % | 1.52 | | | (7.80) |
| Ash, wt % | 13.55 | | | |
| $CO_2$, wt % | | | | 15.00 |
| CO, wt % | | | | .04 |
| $SO_x$ ($SO_2$ + $SO_3$), ppm | | | | 79. |
| NO (NO + $NO_2$), ppm | | | | 77. |
| Hydrocarbons (as $CH_4$), ppm | | | 205. | |
| Temperature within Fluidized Bed = 1500° F. | | | | |
| Gas Velocity, $ft^3/sec\text{-}ft^2$ = 8.3 | | | | |

TABLE 19

| Analysis | Stream: Coal Feed | Sorbent Catalyst C8 | Combustion Air | Flue Gas (Dry) |
|---|---|---|---|---|
| Carbon, wt % | 69.90 | | | |
| Hydrogen, wt % | 4.53 | | | |
| Nitrogen, wt % | 0.96 | | 76.80 | 82.17 |
| Oxygen, wt % | 5.46 | | 23.2 | 2.70 |
| Sulfur, wt % | 4.03 | 0. | | |
| Moisture, wt % | 1.57 | 0. | | (7.70) |
| Ash, wt % | 13.55 | | | |
| $CO_2$, wt % | | | | 15.10 |
| CO, wt % | | | | .01 |
| $SO_x$ ($SO_2$ + $SO_3$), ppm | | | | 77. |
| $NO_x$ (NO + $NO_2$), ppm | | | | 88. |
| Hydrocarbons (as $CH_4$), ppm | | | | 79. |
| Temperature within Fluidized Bed = 1580° F. | | | | |

TABLE 19-continued

| Analysis | Stream: Coal Feed | Sorbent Catalyst C8 | Combustion Air | Flue Gas (Dry) |
|---|---|---|---|---|
| Velocity, $ft^3/sec\text{-}ft^2$ = 7.9 | | | | |

TABLE 20

| Analysis | Stream: Coal Feed | Sorbent Catalyst C9 | Combustion Air | Flue Gas (Dry) |
|---|---|---|---|---|
| Carbon, wt % | 69.90 | | | |
| Hydrogen, wt % | 4.53 | | | |
| Nitrogen, wt % | 0.96 | | 76.8 | 81.80 |
| Oxygen, wt % | 5.44 | | 23.2 | 2.90 |
| Sulfur, wt % | 4.03 | | | |
| Moisture, wt % | 1.52 | | | (7.50) |
| Ash, wt % | 13.55 | | | |
| $CO_2$, wt % | | | | 15.30 |
| CO, wt % | | | | .01 |
| $SO_x$ ($SO_2$ + $SO_3$), ppm | | | | 80. |
| NO (NO + $NO_2$), ppm | | | | 78. |
| Hydrocarbons (as $CH_4$), ppm | | | | 80. |
| Temperature within Fluidized Bed = 1575° F. | | | | |
| Gas Velocity, $ft^3/sec\text{-}ft^2$ = 7.5 | | | | |

SUMMARY OF SORBENT-CATALYSTS USED IN EXAMPLES 6–15

Bed material samples were prepared by dry blending stoichiometric quantities of dry powders of calcium carbonate and titanium dioxide and heating the mixture in a kiln at 1100 degrees C. The prepared agglomerates of calcium titanate were then impregnated with varying amounts of catalysts as per the list below.

| Sample | Catalysts | Wt % Catalyst ($T_L$) | Catalyst Wt. Ratios |
|---|---|---|---|
| Calcium Titanate-$Fe_2O_3$ | $Fe_2O_3$ | 0.3 | — |
| C1 | Cu | 0.3 | — |
| C2 | Cu | 0.5 | — |
| C3 | Ni | 0.3 | — |
| C4 | Ni | 0.5 | — |
| C5 | Co | 0.3 | — |
| C6 | Cu/Ni | 0.3 | 1:1 |
| C7 | Cu/Ni | 0.5 | 1:1 |
| C8 | Cu/Pt | 0.3 | 5:1 |
| C9 | Cu/Ni/$R_h$ | 0.3 | 3:3:1 |

What is claimed is:

1. A method for catalytically converting unburned hydrocarbons and carbon monoxide to carbon dioxide and reducing nitrogen oxides to nitrogen during or subsequent to the combustion of fossil fuels while absorbing sulfur oxides, which comprises contacting gaseous products of said combustion with a catalytic material for catalyzing said conversion and reduction reactions, said catalytic material being physically combined onto an adsorbent matrix selected from the group consisting of calcium aluminate, calcium aluminate cement, barium titanate, and calcium titanate.

2. The method of claim 1 wherein said catalytic material is selected from the group consisting of base metals, transition metals, and precious metals and the oxides thereof.

3. The method of claim 2 wherein said catalytic material is selected from the group consisting of Ni, Cu, Co, Pt, Pd, Rh alone or in combination.

4. The method of claim 1 wherein said catalytic material is impregnated onto said adsorbent matrix in an amount of 0.05 to 5 percent based on the weight of catalytic material and adsorbent.

5. The method of claim 1 wherein said fossil fuel is coal.

6. The method of claim 1 wherein the molar ratio of catalytic adsorbent material used is 0.5 to 10 parts per part of sulfur in the fossil fuel being combusted.

7. The method of claim 1 wherein said combined catalytic material and adsorbent are regenerated subsequent to combustion to restore their respective catalytic and adsorbent properties.

8. The method of claim 1 wherein said combined catalytic material and adsorbent are contacted with said combustion products during or after combustion or in a packed, moving or fluidized bed.

9. The method of claim 8 wherein said contacting is in a post combustion zone.

10. The method of claim 1 wherein fine particulates are also removed from said gaseous combustion products in a fixed or moving bed.

11. The process of claim 1 wherein said conversion occurs at a temperature of 300 degrees to 2000 degrees F.

12. A method for treating reducing gases containing one or more gaseous components selected from the group consisting of hydrogen sulfide, ammonia and carbonyl sulfide to reduce said gaseous components to non-polluting components and adsorbed sulfur which comprises contacting said reducing gases with a catalytic material for said conversion which is physically combined onto an adsorbent matrix selected from the group consisting of calcium aluminate, calcium aluminate cements, barium titanate, and calcium titanate.

13. The method of claim 12 wherein fine particulates are removed in a fixed or moving bed.

* * * * *